United States Patent [19]

Buvik

[11] 4,329,081

[45] May 11, 1982

[54] DEVICE FOR LAYING ROAD MATERIAL

[76] Inventor: Stig Buvik, P1 6165, S-685 00 Torsby, Sweden

[21] Appl. No.: 140,494

[22] Filed: Apr. 15, 1980

[30] Foreign Application Priority Data

May 4, 1979 [SE] Sweden ..... 7903901

[51] Int. Cl.[3] ..... E01C 19/18

[52] U.S. Cl. ..... 404/110

[58] Field of Search ..... 404/110, 101, 104, 108

[56] References Cited

U.S. PATENT DOCUMENTS

| | | | |
|---|---|---|---|
| 1,401,149 | 12/1921 | Foster | 404/110 |
| 1,767,243 | 6/1930 | Kime | 404/110 |
| 1,861,925 | 6/1932 | Kime | 404/110 |
| 2,339,518 | 1/1944 | Reisser | 404/110 X |
| 3,029,714 | 4/1962 | Creswell | 404/110 |
| 3,108,517 | 10/1963 | Fingland | 404/110 |
| 3,208,360 | 9/1965 | Hayes | 404/110 |
| 3,300,234 | 1/1967 | Layton | 404/110 X |
| 3,373,669 | 3/1968 | Schmitz | 404/110 |
| 4,102,590 | 7/1978 | Zanzie | 404/110 |
| 4,188,152 | 2/1980 | Kitt | 404/110 |

*Primary Examiner*—Nile C. Byers, Jr.
*Attorney, Agent, or Firm*—Murray and Whisenhunt

[57] ABSTRACT

An asphalt layer adapted to be towed after a towing vehicle comprising in combination on the one hand a back wall (6), the lower edge of which determines the upper surface of the layer of material which is laid out, on the other hand a trough-shaped bucket (9) in front of the back wall. The bucket can be turned in relation to the back wall about a horizontal fulcrum (X) parallel to the back wall, and the material in the bucket can be emptied out into the space in front of the back wall. Partitions (39) and (40) or (30) and (31), are disposed in said space and in the bucket to regulate the layer of material to the required width. The first mentioned partitions have a concave front edge which follows on the arc which is generated by the front edge of the bucket when the bucket is turned about its fulcrum. The device (1) may appropriately be connected to a central-pivoted tractor (2).

8 Claims, 4 Drawing Figures

2
4
4
IV
1
11
33
32
31
12
30
38
36
6
37
16
Z
IV

DEVICE FOR LAYING ROAD MATERIAL

TECHNICAL FIELD

The invention relates to a device for laying road material such as asphalt, gravel and oil mat road surface. More specifically, the invention relates to a laying device adapted to be towed behind a towing vehicle, particularly a towing vehicle provided with lifting arms, such as a loading machine.

PRIOR ART

Devices for laying asphalt and other road materials generally have the form of very large machines with a high capacity. These are well-suited for laying road material in connection with large-scale roadworks and/or street works but naturally cannot be used for lesser work such as laying paths in parks and gardens, garage drives and similar more restricted areas. In this case, manual laying with shovels and rakes continues to dominate although the work is extremely taxing and causes wear, particularly of the back, through the combination of unsuitable working positions and heavy lifting.

Attempts have long been made to solve this problem by various constructions of laying devices adapted to be towed after a towing vehicle. An early construction is shown for example in the U.S. Pat. No. 1,401,149 published in the year 1921 and similar constructions are described in the U.S. Pat. Nos. 1,767,243 and 1,861,925. It is common to these constructions that the device is towed after a vehicle with a large load capacity, for example a lorry, which gradually tips the material into the laying device. Such an equipage is difficult to manoeuvre, however, and is therefore only suitable in exceptional cases for the case of the precision laying of asphalt and other road material which is intended here. The constructions previously proposed have not, in practice, constituted a real alternative to hand laying for small and medium laying work, particularly not for work which demands precision.

DISCLOSURE OF THE INVENTION

The object of the invention is to offer a practical device adapted for laying road material particularly for park and garden paths, pavements, garage drives, repair work etc, that is to say for situations which impose demands on the capacity of the device to manage sharp turns, especially broad ones, laying close to obstacles and so on.

It is also an object to offer a device with which it is also possible to fetch a certain amount of material from a supply, in which case the device can act as a transport container.

Another object is to offer a device with which the material can be fed to the ground in a regular manner and with which a layer of paving material can be laid out with the required width and thickness.

A further object is to offer a device adapted to existing working machines, and the device, possibly after the uncoupling of certain parts, can also be used for other purposes in connection with paving work, for example removing and loading material, lifting goods and so on.

These and other objects can be achieved with the device according to the invention which comprises, in combination, on the one hand a back wall, the lower edge of which determines the upper surface of the layer of material which is laid out, on the other hand, a trough-shaped bucket in front of the back wall, which bucket is adapted to be able to turn in relation to the back wall about a horizontal turning centre parallel to the back wall, and, by turning the bucket in relation to the back wall, material in the bucket can be emptied out into the space between the back edge of the bucket and said back wall.

In order to be able to lay the layer with a regular width, a pair of partitions are preferably disposed in the bucket between its gables and, as extensions of the partitions in the bucket, also partitions in the space between the back wall and the back edge of the bucket, which partitions are adapted to determine the width of the layer of material which is laid out. In this case, the back edge of the partitions between the back wall and the edge of the bucket turned towards said wall may appropriately be concavely arcuate, the arc substantially coinciding with a sector of the circle which is generated by the back edge of the bucket when the bucket is turned about its turning centre.

According to the selected form of embodiment, a pair of outer gables connected to the back wall are disposed outside the gables of the bucket, the bucket being connected to said outer gables by a pair of pivot pins. These extend between the bucket gable and outer gable and coincide with and determine the fulcrum of the bucket. The device according to the invention may appropriately be connected to the towing vehicle via a pair of arms by means of which the devide is also adapted to be able to be lifted from the ground, and in the lifted-up position of the device, the bucket is adapted to be able to act as a transport container during the fetching of road material from a supply to the laying site.

Further objects of and characteristics of the invention are apparent from the following description of a preferred form of embodiment.

BRIEF DESCRIPTION OF DRAWINGS

In the following description of the preferred form of embodiment, reference is made to the accompanying drawings in which.

DESCRIPTION OF PREFERRED FORM OF EMBODIMENT

Figure 1:
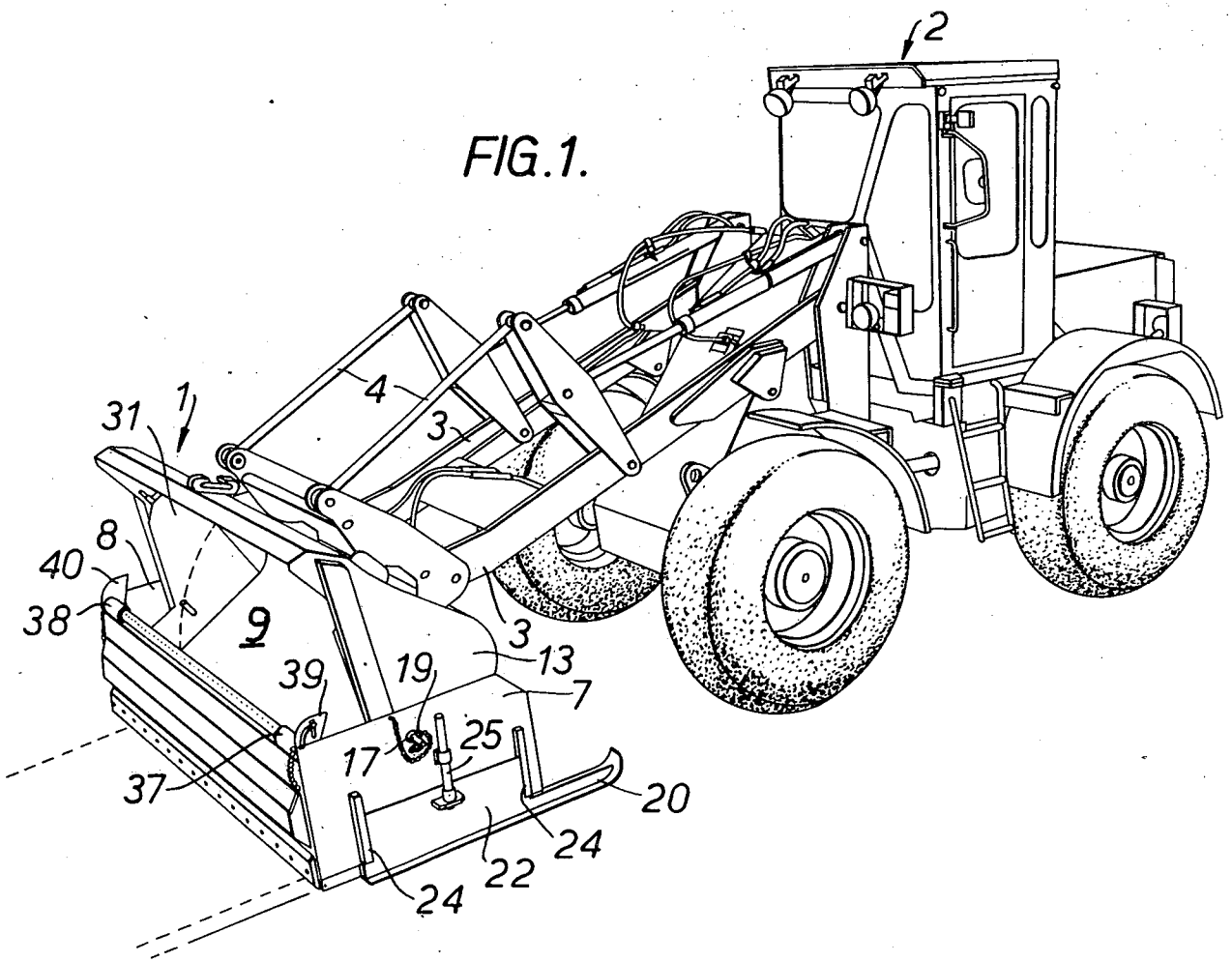
FIG. 1 is a perspective view illustrating how a layer of asphalt is laid with the device according to the invention.

Referring to the figures, the device according to the invention—an asphalt layer—is designated in general by the numeral 1 and a towing vehicle by the numeral 2. The asphalt layer 1 is connected to the towing vehicle 2 by a pair of lifting arms 3 and can be manoeuvred by a pair of manoeuvring rods 4 and a coupling link 5. The towing vehicle 2 is made in the form of a centre-pivoted tractor. The lifting arms 3 and the manoeuvring rods 4 are manoeuvred hydraulically. The towing vehicle 2 moves backwards during the laying, pulling the layer 1 after it.

The main parts of the device 1 consist of a back wall 6 with outer gables 7 and 8 and a trough-shaped bucket 9 with back and front walls 10 and 11, bottom 12 and gables 13 and 14. The bucket 9 can be turned by means of the manoeuvring rods 4 and the coupling links 5, about a horizontal fulcrum X which is parallel to the back wall 6. The bucket 9 is further connected to the outer gables 7 and 8 by means of a pin 17 and 18, disposed in each gable 13 and 14, FIG. 1 and FIG. 4, which pins determine said fulcrum X. The pins 17 and 18 are fixed by a key coupling to the outsides of the outer gables 7 and 8. A key is designated by 19 in FIG. 1.

The back plate 6 comprises a reinforcement 15 and is provided at the bottom with a road-grader blade 16. The device 1 is adapted to be able to be pulled over the ground on a pair of runners 20 and 21. The runners 20 and 21 are connected to a pair of vertical side plates 22 and 23 which can be displaced up and down in relation to the outer gables 7 and 8 in a pair of guides designated 24 in FIG. 1. A screw 25 is disposed between the side plate 22 and the outer gable 7 for adjustment in height. In a corresponding manner, a screw is disposed at the opposite side of the device. Extending between the side plates 22 and 23 is a transverse axle 26 mounted in bearing brackets 27 which rest on the runners 20 and 21. Disposed on the axle 26 are a number of wheels 28 intended to relieve the runners 20 and 21 so that these do not exert too heavy a pressure on the bed, which might lead to the fact that the runners dig into the bed.

Disposed in the bucket 9, between the gables 7 and 8, is a pair of partitions 30 and 31. These can turn about a joint 32 or 33 respectively mounted close to the gables 7 and 8, substantially at right angles to the back wall 10 of the bucket. Each pin 32 and 33 is protected from shocks by a brace 34 and each partitions 30 and 31 is provided in its lower portion with an extension 35 which can be extended to lengthen the wall. Separate adjusting members which are not shown in the Figures, are provided to adjust the partitions 30 and 31 in various positions.

A tube 36 extends between the outer gables 7 and 8, immediately in front of the upper edge of the back wall. A pair of sleeves 37 and 38 are adapted for displacement on the tube 36 and adjustable in various positions. The sleeves 37 and 38 carry a vertical partition 39 and 40 respectively, between the back wall 6 and the back edge 41 of the bucket 9. The partitions 39 and 40 are alike in shape and comprise a concave front edge 42 which substantially follows the arc which is generated by the back edge 41 of the bucket when the bucket is turned about its fulcrum X. In their lower portion, the partitions 39 and 40 comprise a portion which can be raised and lowered and which is designated by 43 in FIG. 4. The member for adjusting the part 43 at various heights is not shown in the Figures.

The device thus described is adapted to be handled in the following manner. The desired width of the layer of asphalt or other road material which is to be laid is adjusted by means of the partitions 30 and 31 in the bucket 9 and partitions 39 and 40 in the space between the back wall 6 and the back edge 41 of the bucket. In the course of this, the partitions 30 and 31 are turned about their respective joints 32 and 33 and if necessary the extensions 35 are also adjusted so that the partitions in the bucket may have the desired length. Then the partitions 39 and 40 are displaced in that the sleeves 37 and 38 are displaced along the rod 36 until the partitions 39 and 40 follow on the parts of the partitions 30 and 31 of the bucket projecting beyond the back edge 41 of the bucket, or their extensions. The partitions 39 and 40 are fixed in position by means of locking pins which are introduced into holes provided for the purpose in the tube 36. The desired thickness of the layer which is to be laid is adjusted by means of the screws 25. The lower extensions 43 of the partitions 39 and 40 may also be adjusted depending on whether it is desired to lay a layer with a straight edge or, for example, lay a layer which is to follow on a layer previously laid or on a kerbstone or the like.

Figure 2:
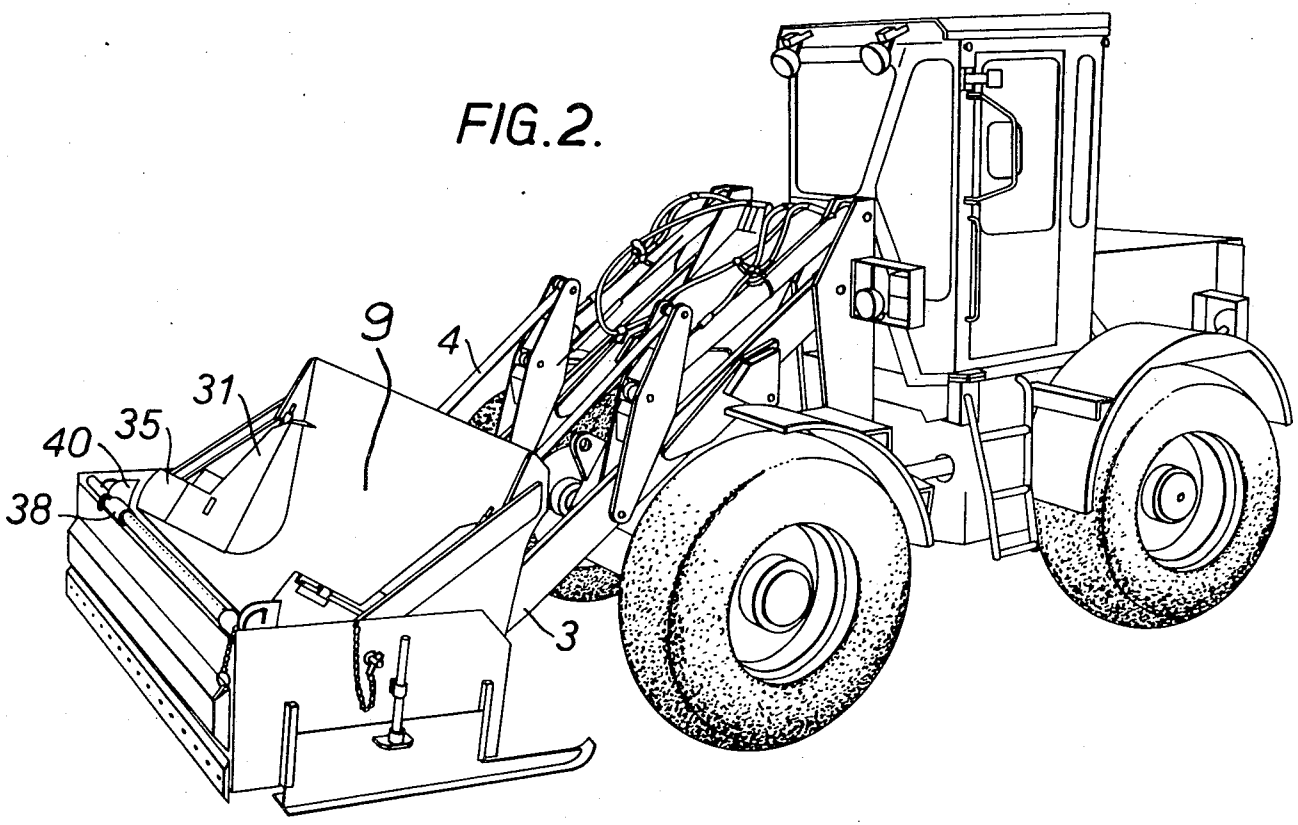
FIG. 2 shows the same device in the transport position
Figure 3:
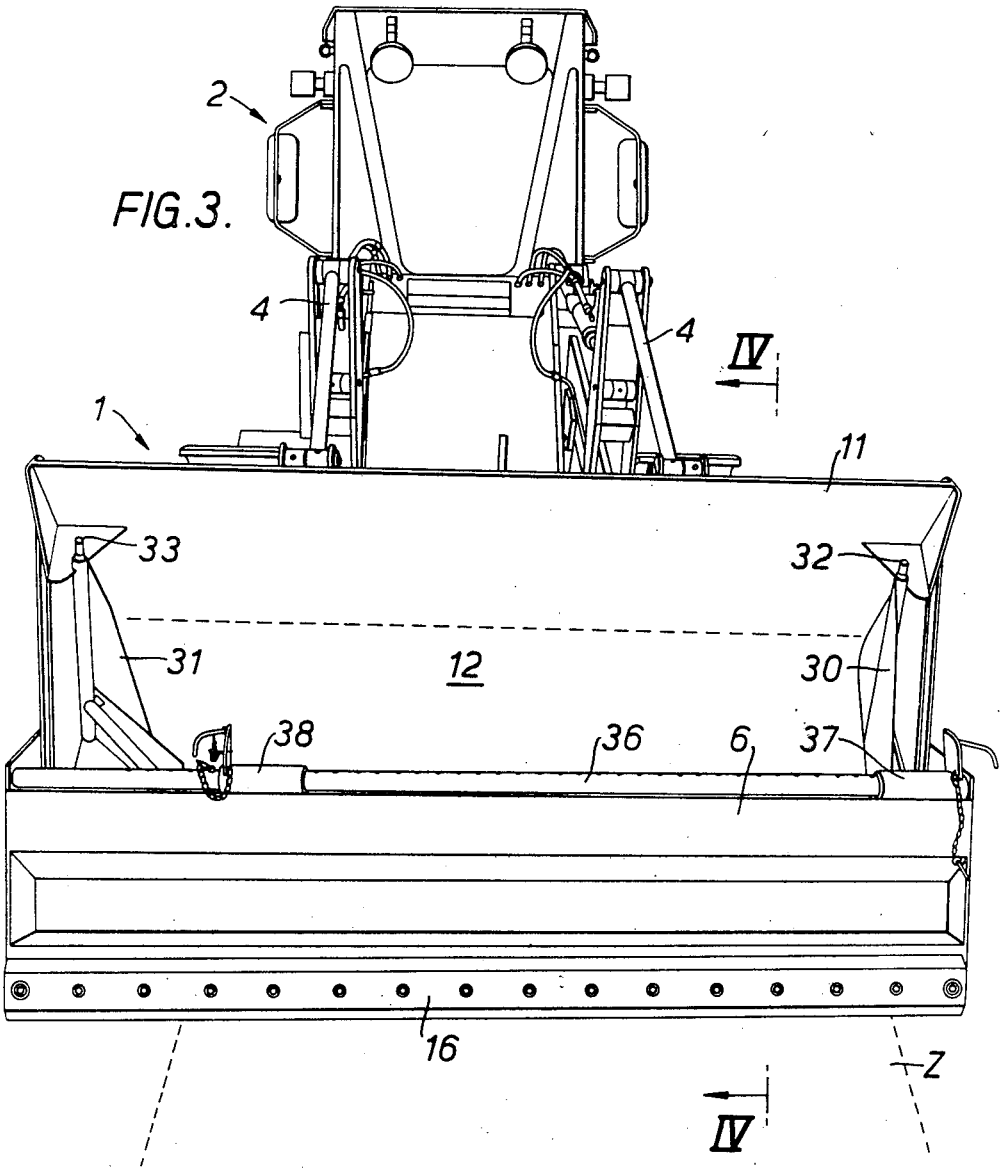
FIG. 3 is a perspective view of the device seen from the back, that is to say in the direction of the trailing end of the device.
Figure 4:
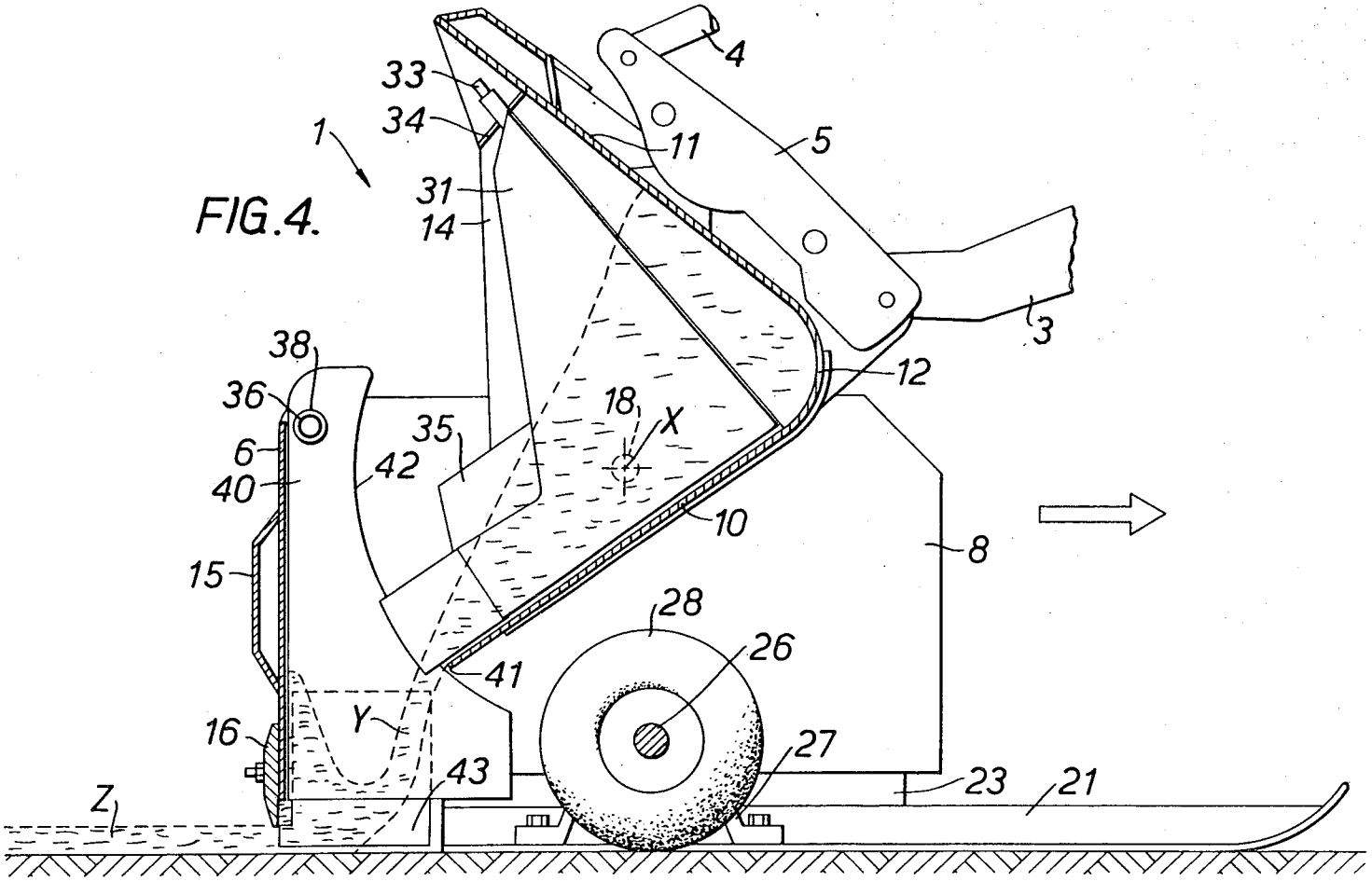
FIG. 4 is a section on IV—IV in FIG. 3.

In the transport position, the bucket 9 is caused to adopt the position shown in FIG. 2, that is to say with the bottom 12 of the bucket facing downwards, the necessary turning movement being brought about by means of the manoeuvring rods 4 and the coupling links 5. The device 1 is lifted from the ground by means of the lifting arms 3, after which the whole equipage is displaced to a supply of asphalt or other paving material, or to a transport vehicle which contains a large amount of material of the kind which is to be laid. The bucket 9 is filled with a suitable amount of material, after which the equipage is displaced to the place where the material is to be laid. The device 1 is lowered towards the ground and the lifting arms 3 are adjusted into the "floating position" if this possibility is provided on the towing vehicle 2. The bucket 9 is turned about its fulcrum X until its material begins to fall down into the space between the back edge 41 of the bucket and the back wall 6. The equipage is now driven backwards, that is to say with the device 1 trailing after the towing vehicle 2. The amount of material which falls down into the space between the back edge 41 of the bucket and the back wall 6, designated by Y in FIG. 4, is evened out by the road-grader blade 16 to an even layer Z with the required width and thickness. The whole time, assurance is provided that there is a certain amount of material Y in front of the back wall 6 and the road-grader blade 16, by adapting the turning of the bucket 9. When the material in the bucket is finished, the bucket is turned back into the horizontal position after which the equipage again travels to the supply of material to fill the bucket with more material, after which the work continues in the manner described above. If an operation has been completed and there is still an amount of unused material in the bucket, this can be convyed back to and emtied into the supply. If the towing vehicle—the tractor 2—is to be used for other work, the back wall 6 and the connected parts are uncoupled by loosening the keys 19, after which the pins 17 and 18 can be removed (the pins 17 and 18 are provided with flanges on the inside of the bucket 9). The partitions 30 and 31 are lifted down, after which the bucket 9 can be used for such work as excavating, loading, digging and so forth. It should be clear that the device according to the invention can be used not only for laying asphalt, gravel and oil mat road surface etc, which has been described in detail in the previous section, but that it can also be used to advantage for preparatory work for such work. For example, the device can be used in the assembled state to adjust and level out the bed for the following asphalting or corresponding paving. The device according to the invention can thus be used as a universal aid for minor undertakings of the kind in question.

I claim:

1. A device for laying road material while towed by a towing vehicle, said device comprising trough-shaped bucket means for holding said road material during transport and for discharging said road material during laying thereof, back wall means, located at the back of said bucket means, for determining the upper surface of the laid layer of road material, said bucket means having gable ends and a back edge and being rotatable, in relation to said back wall means, about a horizontal fulcrum parallel to the back wall means to discharge road material in said bucket means out into a space between the back edge of the bucket means and the back wall means, a pair of adjustable partition means located between the gable ends of the bucket and extending into the space between said back edge and said back wall means to determine the width of the layer of road material to be laid, and joint means disposed adjacent each said gable end for receiving said partition means and for providing a location about which the partition means can be swung.

2. Device of claim 1, wherein said back wall means is adjustable to determine the upper surface of the road material laid layer independent of the rotational location of the bucket means.

3. Device of claim 1, wherein said partition means includes a pair of primary partitions disposed in said bucket means and extension partition means in the space between the back wall means and said back edge for being the primary part of said apparatus determining the width of the layer of road material laid.

4. Device of claim 3, wherein said extension partition means are displaceable along the back wall, and have a back edge adjacent to said bucket means and concavely arcuated, the arc substantially coinciding with a sector of the circle which is generated by the back edge of the bucket means when the bucket is turned about its horizontal fulcrum.

5. Device of claim 3, wherein said extension partition means are provided with extensions which can be raised and lowered on the lower portion thereof.

6. Device as claimed in any one of claims 1–5, further including a pair of outer gable means connected to the back wall means outside of the bucket means gables, the bucket means being connected to the outer gable means by a pair of pivot pins, one pin extending between the bucket means gable and the outer gable means, said pins coinciding with and determining the fulcrum of the bucket means.

7. Device as claimed in any of claims 1–5, wherein a runner means is connected to each outer gable means, and said outer gable means together with the back wall means connected thereto are adjustable in vertical height in relation to said runner means to regulate the thickness of the road material laid layer, said runner means at least in part supporting the weight of said device upon the ground.

8. Device of claim 7, further including a transverse axle means between said runner means, said axle means provided with a plurality of supporting wheel means for relieving the runners of some of the weight of said device, so as to reduce the pressure of said runner means against the surface upon which the road material is to be laid.

* * * * *